US012781963B2

(12) United States Patent
Kamoi et al.

(10) Patent No.: US 12,781,963 B2
(45) Date of Patent: Nov. 3, 2026

(54) GAS TURBINE WALL MEMBER HAVING FILM COOLING HOLES AND MANUFACTURING METHOD THEREOF

(71) Applicant: HONDA MOTOR CO., LTD., Tokyo (JP)

(72) Inventors: Yasuharu Kamoi, Saitama (JP); Toshiyuki Tsuji, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 19/022,305

(22) Filed: Jan. 15, 2025

(65) Prior Publication Data

US 2025/0244015 A1 Jul. 31, 2025

(30) Foreign Application Priority Data

Jan. 30, 2024 (JP) ..... 2024-011898

(51) Int. Cl.
*F23R 3/06* (2006.01)

(52) U.S. Cl.
CPC ..... *F23R 3/06* (2013.01); *F23R 2900/00018* (2013.01); *F23R 2900/03044* (2013.01)

(58) Field of Classification Search
CPC .. F23R 3/06; F23R 2900/03044; F01D 5/186; F01D 25/12
See application file for complete search history.

(56) References Cited

U.S. PATENT DOCUMENTS

| | | | | |
|---|---|---|---|---|
| 5,129,231 | A * | 7/1992 | Becker | F23R 3/14 60/754 |
| 6,978,618 | B2 * | 12/2005 | Pacheco-Tougas | F23R 3/002 60/754 |
| 7,146,816 | B2 * | 12/2006 | Anderson | F23R 3/002 60/754 |
| 7,260,936 | B2 * | 8/2007 | Patel | F23R 3/12 60/754 |
| 7,506,512 | B2 * | 3/2009 | Schumacher | F23R 3/50 60/754 |
| 7,568,350 | B2 * | 8/2009 | Kreder | F23R 3/60 60/796 |
| 8,092,177 | B2 * | 1/2012 | Liang | F01D 5/186 416/97 R |
| 9,284,844 | B2 * | 3/2016 | Xu | F01D 9/065 |
| 9,506,652 | B2 * | 11/2016 | Carrere | F23R 3/12 |
| 10,208,602 | B2 * | 2/2019 | Thornton | F02C 3/04 |
| 10,808,929 | B2 | 10/2020 | Kamoi et al. | |
| 11,459,898 | B2 * | 10/2022 | Mongillo, Jr. | F23R 3/002 |
| 11,754,285 | B2 | 9/2023 | Kamoi et al. | |
| 11,965,429 | B1 * | 4/2024 | VanTassel | F01D 5/186 |
| 12,007,114 | B1 * | 6/2024 | Vukanti | F23R 3/10 |

(Continued)

FOREIGN PATENT DOCUMENTS

| | | |
|---|---|---|
| JP | 2018017497 A | 2/2018 |
| JP | 2022150946 A | 10/2022 |

*Primary Examiner* — William H Rodriguez
(74) *Attorney, Agent, or Firm* — Armstrong Teasdale LLP

(57) ABSTRACT

Provided is a wall member such as the liner of a combustor for a gas turbine engine having a through hole inclined from the vertical direction which can be favorably manufactured by the AM method. In cross section, the through hole includes a shaped part having an upper half part and a lower half part, the upper half part being more acute than the lower half part.

12 Claims, 8 Drawing Sheets

(56) References Cited

U.S. PATENT DOCUMENTS

2004/0083735 A1* 5/2004 Borns ..... F23R 3/10 60/752
2006/0042263 A1* 3/2006 Patel ..... F23R 3/12 60/776
2008/0066468 A1* 3/2008 Faulder ..... F23R 3/283 60/737
2008/0104962 A1* 5/2008 Patel ..... F01D 25/12 60/752
2009/0077977 A1* 3/2009 Cayre ..... F23R 3/06 60/757
2013/0205790 A1* 8/2013 Xu ..... F01D 5/186 415/116
2013/0205801 A1* 8/2013 Xu ..... F01D 9/065 29/889.22
2013/0209236 A1* 8/2013 Xu ..... F01D 9/041 415/116
2015/0226433 A1* 8/2015 Dudebout ..... F23R 3/002 60/752
2016/0008889 A1* 1/2016 Xu ..... B22F 7/08 219/76.12
2016/0024937 A1* 1/2016 Xu ..... F01D 9/065 416/95
2016/0177733 A1* 6/2016 Lewis ..... F01D 5/147 29/889.721
2016/0201474 A1* 7/2016 Slavens ..... F01D 9/041 60/806
2016/0251967 A1* 9/2016 Bunker ..... F01D 5/186 416/95
2016/0273364 A1* 9/2016 Bergholz ..... F01D 5/186
2016/0312619 A1* 10/2016 Thornton ..... F01D 25/12
2017/0101870 A1* 4/2017 Lewis ..... F01D 5/186
2017/0268346 A1* 9/2017 Webster ..... F23R 3/002
2017/0268347 A1* 9/2017 Dahlke ..... F01D 5/186
2017/0298743 A1* 10/2017 Webster ..... F23R 3/04
2017/0356294 A1* 12/2017 Torkaman ..... F01D 5/186
2018/0010465 A1* 1/2018 Xu ..... F23R 3/06
2018/0135520 A1* 5/2018 Lewis ..... F01D 11/08
2018/0230811 A1* 8/2018 Lewis ..... F01D 5/186
2019/0071977 A1* 3/2019 Webster ..... F01D 9/02
2019/0093892 A1* 3/2019 Rimmer ..... F23R 3/10
2019/0345828 A1* 11/2019 Gossilin ..... F23R 3/06
2019/0390567 A1* 12/2019 Xu ..... F01D 25/12
2020/0024961 A1* 1/2020 Melia ..... F01D 5/18
2020/0326180 A1* 10/2020 Campion ..... F01D 5/186
2022/0018260 A1* 1/2022 Mongillo, Jr. ..... F23R 3/002
2023/0050204 A1* 2/2023 Craig ..... F01D 25/12
2023/0051153 A1* 2/2023 Craig ..... F23R 3/005
2023/0052105 A1* 2/2023 Craig ..... F01D 5/005
2024/0318822 A1* 9/2024 Vukanti ..... F23R 3/06
2025/0065444 A1* 2/2025 Denney ..... B23P 6/002
2025/0244013 A1* 7/2025 Kamoi ..... F23R 3/002

* cited by examiner

GAS TURBINE WALL MEMBER HAVING FILM COOLING HOLES AND MANUFACTURING METHOD THEREOF

TECHNICAL FIELD

The present invention relates to a wall member such as a liner of a combustor for a gas turbine engine, and a method of manufacturing such a wall member.

BACKGROUND ART

In combustors for gas turbine engines, it is known to form a plurality of cooling air holes through the liner or the wall member of the combustor so that cooling air introduced from the cooling air holes into the combustion chamber flows along the inner wall surface of the liner facing the combustion chamber to favorably cool the liner.

In order for the cooling air introduced from the cooling air holes into the combustion chamber to effectively cool the liner, it is desired that the cooling air flows closely along the inner surface of the liner facing the combustion chamber as a laminar flow.

If the flow velocity of the cooling air ejected from the cooling air holes into the combustion chamber is high and a large turbulent component is included in the air flow, the cooling air tends to separate from the wall surface of the liner, hindering the cooling of the liner. Therefore, it is preferable to reduce the flow velocity of the cooling air as much as possible and minimize the turbulent component of the air flow. To achieve this goal, it is preferable to progressively and smoothly increase the cross-sectional area of the cooling air holes from the inlet to the outlet, thereby promoting the deceleration of the cooling air flowing through the cooling air holes without creating turbulence. Thereby, the liner can be cooled effectively by the cooling air. It is known in the art to form the cooling air holes at an angle with respect to the thickness direction of the liner wall in order to cause the cooling air to flow closely along the wall surface of the liner and increase the passage length of the cooling air holes for the given thickness of the liner (See JP2018-17497A and JP2022-150946A, for instance).

In order to enhance the cooling effect in such a structure, it has been practiced to form cooling air holes in complex configurations. The AM (Additive Manufacturing) method is known in the art, and this method provides a solution for forming such cooling air holes. According to the AM method, the product is formed by depositing metallic material in layers until a desired shape is formed. For instance, when cooling air holes are desired to be formed in the end wall of a liner of a combustor, the cooling air holes may be formed in the end wall while the end wall is formed by the AM process.

In such a situation, if the cooling air holes to be formed extend vertically, the cooling air holes can be formed without any problem. However, if the cooling air holes are inclined with respect to the vertical direction, there is a risk that the unsolidified metal forming the upper side of each cooling air hole may drip down under the gravitational force, and there is a limit to the possible inclination angle of the cooling air holes. In particular, when the cooling air holes have a laterally elongated cross section such as an oval shape, or when the cooling air holes have a large cross-sectional area, the surface forming the upper side of each cooling air hole has a small curvature so that the tendency for the metal material to drip down increases.

SUMMARY OF THE INVENTION

In view of such a problem of the prior art, a primary object of the present invention is to provide a wall member such as the liner of a combustor for a gas turbine engine having a through hole inclined from the vertical direction which can be favorably manufactured by the AM method and a method of manufacturing a wall member having a through hole inclined from the vertical direction.

In order to achieve such an object, one aspect of the present invention provides a wall member (102) having a through hole (108) extending from a first surface (102A) of the wall member to a second surface (102B) opposite from the first surface, the through hole being inclined with respect to a vertical direction by a predetermined inclination angle ($\alpha$), wherein in cross section the through hole includes a shaped part (108B) having an upper half part (108F) and a lower half part (108G), the upper half part being more acute than the lower half part.

According to this aspect, when the wall member is formed by the AM method from the first surface at the bottom to the second surface at the top, since the upper side of the through hole is more acute (or less blunt) than the lower side thereof, the through hole can be formed favorably even when the inclination angle of the through hole is relatively large.

In the above aspect, preferably, in cross section a top part consists of a part of a circle, and side parts each consists of a tangential line connected to a corresponding end of the top part.

Thereby, the through hole can be formed particularly favorably by the AM method even when the inclination angle of the through hole is relatively large.

In the above aspect, preferably, the shaped part of the through hole is laterally wider on the side of the first surface than on the side of the second surface in cross section.

According to this aspect, even when the thickness of the wall member is limited, a through hole with a relatively large cross-sectional area can be formed and the application of the AM process can be facilitated.

In the above aspect, preferably, the shaped part of the through hole has a cross section that is progressively enlarged along a length of the through hole toward the side of the second surface.

According to this aspect, the flow velocity of the fluid can be favorably reduced without creating turbulence.

In the above aspect, preferably, the through hole is a cooling medium hole for passing a cooling medium from the side of the first surface to the side of the second surface.

According to this aspect, the flow velocity of the cooling medium can be favorably reduced without creating turbulence so that the cooling efficiency of the cooling medium can be improved.

In the above aspect, preferably, the through hole includes, along the length thereof, an upstream portion having a substantially constant cross section located on the side of the first surface and a downstream portion consisting of the shaped part located on the side of the second surface, a lower edge of the downstream portion being more inclined than an upper edge of the downstream portion.

Thereby, the effective inclination of the through hole can be increased without increasing the difficulty of applying the AM method. Furthermore, the tendency of the fluid to flow such as a cooling medium along the second surface of the wall member can be improved.

In the above aspect, preferably, an upper edge of the upstream portion and the upper edge of the downstream portion extend along a common line, and the lower edge of the downstream portion is connected to a lower edge of the upstream portion, the lower edge of the downstream portion being more inclined than the lower edge of the upstream portion.

According to this aspect, even when the downstream portion is wider than the upstream portion, the through hole, in particular the wider downstream portion can be manufactured by the AM method in a particularly favorable manner.

In the above aspect, preferably, the downstream portion has a lateral width that progressively increases toward the side of the second surface along the length of the through hole.

According to this aspect, even when the thickness of the wall member is limited, a through hole with a particularly large cross-sectional area can be formed by the AM method.

In the above aspect, preferably, the upper half part of the shaped part of the through hole has a rounded triangular shape in cross section.

According to this aspect, even when the through hole is significantly inclined with respect to the vertical direction, the material of the wall member is prevented from dripping down during the manufacturing process of the wall member by the AM method.

In the above aspect, preferably, the rounded triangular upper half part has an apex angle (γ) of 90 degrees or less.

Thereby, dripping of the material of the wall member can be favorably prevented during the manufacturing process of the wall member by the AM method.

In the above aspect, preferably, the shaped part of the through hole has a rounded rectangular lower half part (108G) smoothly connected to the rounded triangular upper half part in cross section.

According to this aspect, the cross-sectional area of the shaped part can be maximized for the given thickness of the wall member.

In the above aspect, preferably, the wall member is a part of a liner of a combustor for a gas turbine engine such as an end wall.

Thereby, a high performance combustor for a gas turbine engine can be manufactured in an economical manner.

In the above aspect, when the wall member consists of an annular end wall of a combustor, preferably central axial lines of the cooling air holes on an outer peripheral part thereof are inclined in a clockwise direction and central axial lines of the cooling air holes on an inner peripheral part thereof are inclined in a counter-clockwise direction, in top view.

Thereby, the cooling air is ejected from the cooling air holes in a substantially clockwise direction in the outer peripheral part of the end wall, and the cooling air is ejected from the cooling air holes in a substantially counter-clockwise direction in the inner peripheral part of the end wall so that a favorable cooling free from hot spots can be accomplished.

Another aspect of the present invention provides a method for manufacturing the wall member defined above, wherein an AM method is used for forming the wall member with the first surface at bottom and the second surface at top.

Thereby, a high performance combustor for a gas turbine engine can be manufactured in an economical manner.

The present invention thus provides a wall member such as the liner of a combustor for a gas turbine engine having a through hole inclined from the vertical direction which can be favorably manufactured by the AM method and a method of manufacturing a wall member having a through hole inclined from the vertical direction.

DESCRIPTION OF THE PREFERRED EMBODIMENT(S)

Figure 1:
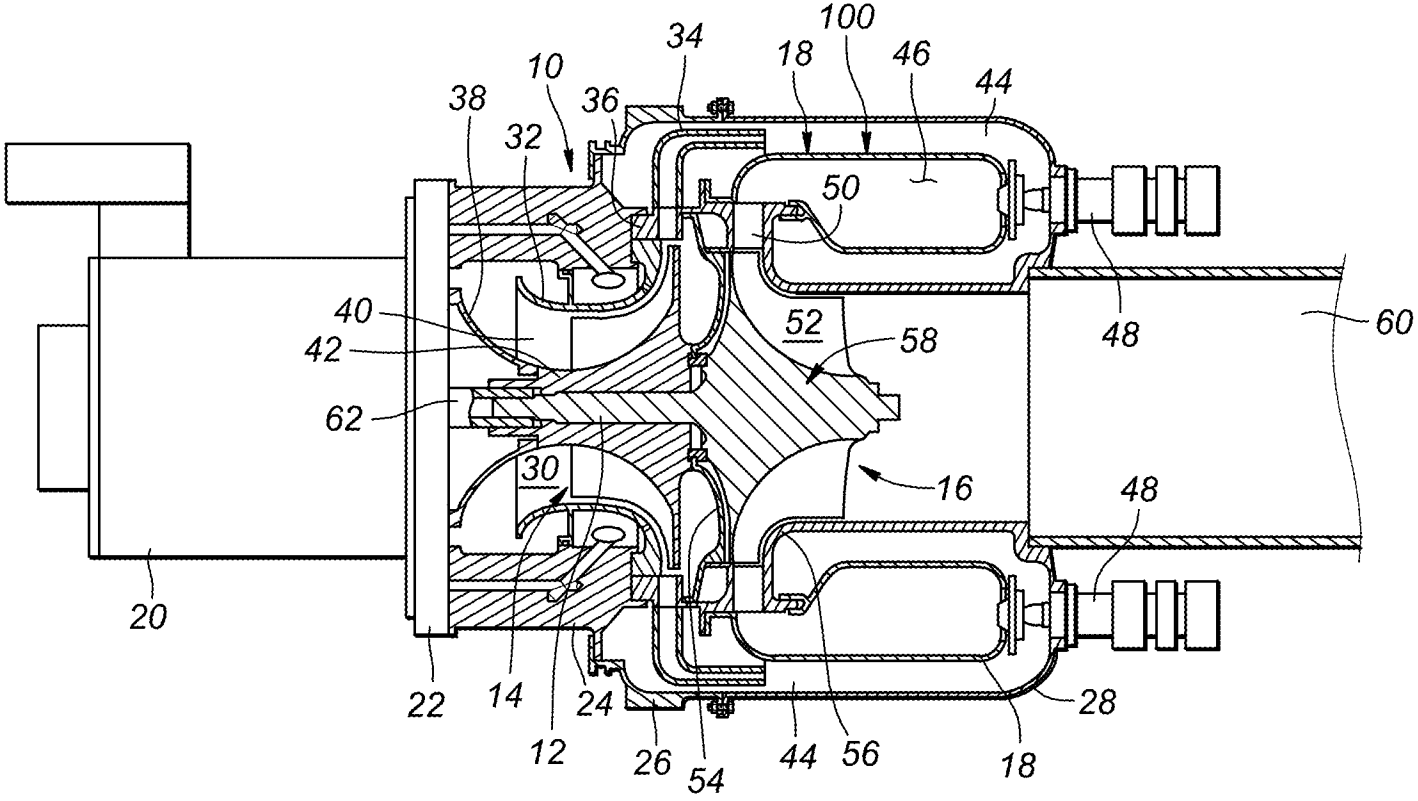
FIG. 1 is a schematic diagram of a gas turbine engine fitted with a combustor according to an embodiment of the present invention.

FIG. 1 is a sectional view of a gas turbine engine system 10 for electric power generation fitted with a combustor according to an embodiment of the present invention. As shown in FIG. 1, the gas turbine engine system 10 comprises a radial compressor 14 and a radial turbine 16 which are disposed coaxial to each other and connected to each other via a rotatable shaft 12. The rotatable shaft 12 is further connected to the input shaft of an electric generator 20.

The gas turbine engine system 10 is provided with a front end plate 22, a front housing 24, an intermediate housing 23 and a rear housing 28 connected to one another in this order. The electric generator 20 is connected to the electric generator 20 at the front end plate 22.

The radial compressor 14 is provided with a compressor liner 32 attached to the front housing 24 to define a compressor chamber 30, a diffuser 34 attached to the front housing via a diffuser fixing member 36, and an air intake guide member 38 attached to the front end plate 22 so as to define an annular air intake 40 in cooperation with the compressor liner 32. A compressor rotor 42 attached to the rotatable shaft 12 is rotatably positioned in the compressor chamber 30. The compressor rotor 42 is rotated by the rotatable shaft 12 which is the output shaft of the radial turbine 16 as will be discussed hereinafter.

The radial compressor 14 draws air (outside air) from the air intake 40, compresses and pressurizes the air by the rotation of the compressor rotor 42, and forwards the compressed and pressurized air (compressed air) into the diffuser 34.

The rear housing 28 includes a part that defines a compressed air chamber 44 into which compressed air is introduced from the diffuser 34. The compressed air chamber 44 has an annular cross-sectional shape about the central axis of the rotatable shaft 12. A combustor 18 is provided in the compressed air chamber 44. The combustor 18 defines a combustion chamber 46 which has an annular cross-sectional shape about the central axis of the rotatable shaft 12.

A plurality of fuel injection nozzles 48 is provided in the combustor 18. The fuel injection nozzles 48 inject fuel into the combustion chamber 46.

The combustors 18 are provided inside the rear housing 28 around the central axis of the rotatable shaft 12. The rear housing 28 includes a part that defines a compressed air chamber 44 into which compressed air is introduced from the diffuser 34. Each combustor 18 defines a combustion chamber 46. A plurality of fuel injection nozzles 48 is attached to the combustor 18 to inject fuel into the combustion chamber 46. In the combustion chamber 46, a mixture of the fuel injected into the combustion chamber 46 by the fuel injection nozzles 48 and the compressed air from the radial compressor 14 is combusted to generate high-temperature combustion gas (compressed fluid). A turbine nozzle 50 is provided at the gas outlet of the combustor 18.

The radial turbine 16 is provided with a turbine chamber 52 that is defined by an inner part of the rear housing 28 and communicates with the gas outlet of the combustor 18. The turbine chamber 52 is separated from the compressor chamber 30 by a partition member 54. The side of the turbine chamber 52 remote from the partition member 54 along the central axis is defined by a shroud 56. A radial turbine impeller 58 that is integrally formed with the rotatable shaft 12 is rotatably positioned in the turbine chamber 52.

The turbine nozzle 50 is annular in shape and surrounds the radial turbine impeller 58, and forwards combustion gas radially inward and circumferentially toward the radial turbine impeller 58. The combustion gas ejected from the turbine nozzle 50 rotationally drives the radial turbine impeller 58. The combustion gas that has rotationally driven the radial turbine impeller 58 is expelled to the atmosphere from an exhaust gas passage 60 defined by a cylindrical member connected to the rear end of the rear housing 28.

The rotatable shaft 12 is connected to a rotor shaft 62 of the generator 20. Thus, the rotatable shaft 12 of the radial turbine 16 drives the generator 20 to generate electric power.

The details of the combustor 18 will be described in the following with reference to FIGS. 1 to 8.

Figure 2:
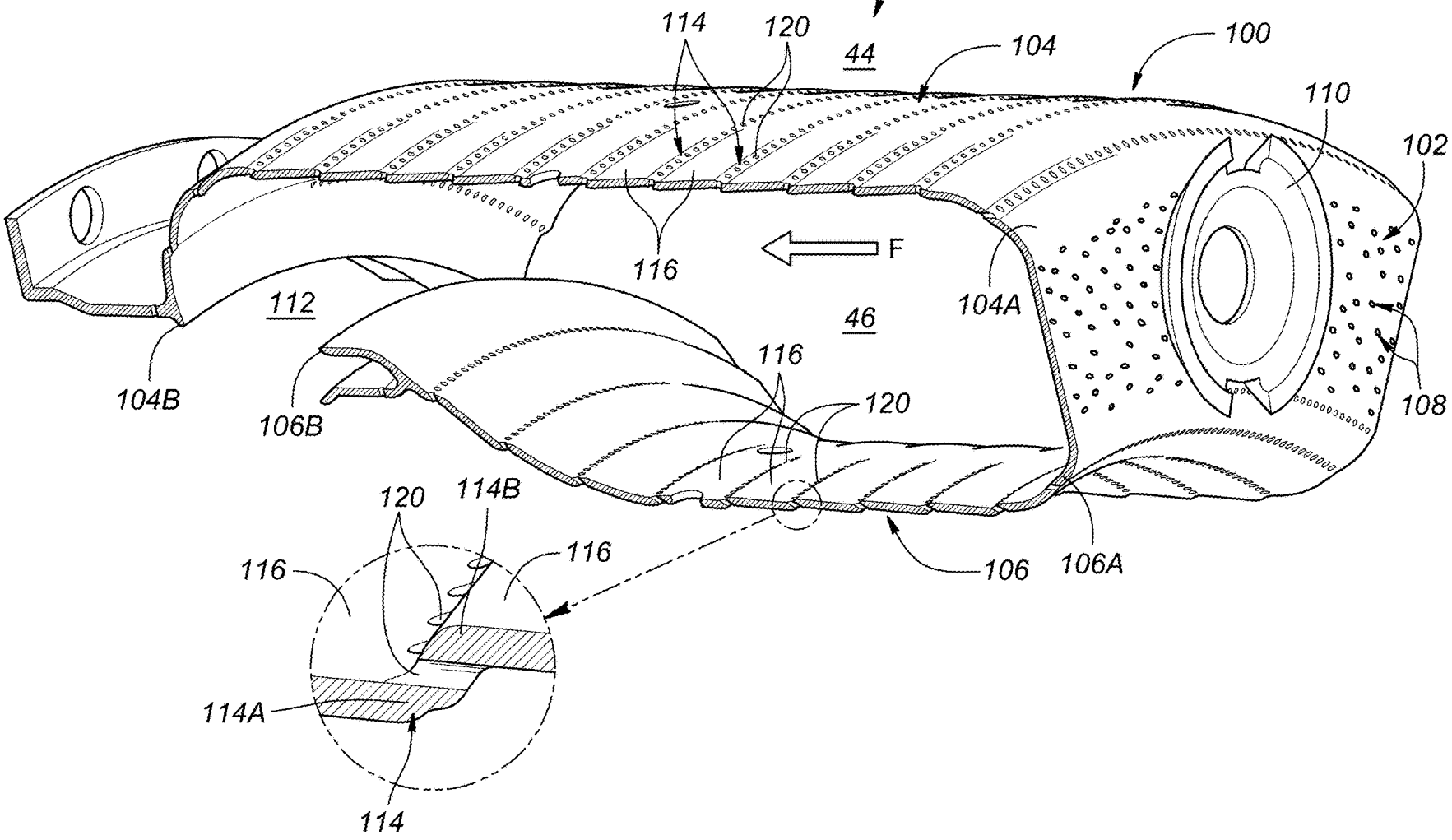
FIG. 2 is a perspective view of the combustor partly in section; a simplified vertical sectional view of the gas turbine engine.

The combustor 18 of the illustrated embodiment consists of an annular combustor, and as shown in FIG. 1, has a liner (housing) 100 disposed approximately concentrically within the annular compressed air chamber 44. As shown in FIG. 2, the liner 100 includes an annular end wall 102 extending substantially orthogonally to the central axis, an outer peripheral wall 104 extending in the axial direction and connected to the outer peripheral edge of the end wall 102 at a first end 104A thereof, and an inner peripheral wall 106 also extending in the axial direction and connected to the inner peripheral edge of the end wall 102 at a first end 106A thereof, defining the annular combustion chamber 46 around the central axis.

The liner 100 is manufactured by the AM (Additive Manufacturing) process, in which metal is layered from bottom to top, with the end wall 102 facing downward and the central axis of the liner 100 extending vertically.

The outer surface of the liner 100 is exposed to the flow of compressed air in the compressed air chamber 44 so that the liner 100 is cooled by the compressed air flowing along the outer surface thereof.

A plurality of mounting portions 110 is formed on the end wall 102 at predetermined intervals in the circumferential direction for mounting the corresponding fuel injection nozzles 48 thereto. Each fuel injection nozzle 48 mixes fuel (supplied via a fuel supply passage not shown in the drawings) with the compressed air in the compressed air chamber 44 and injects the resulting mixture into the combustion chamber 46. In the combustion chamber 46, the mixture is combusted, and generates high-temperature combustion gas.

The second ends 104B, 106B of the outer peripheral wall 104 and the inner peripheral wall 106 oppose each other so as to jointly define an annular combustion gas outlet 112 which faces radially inward. The combustion gas outlet 112 communicates with the turbine nozzle 50 (see FIG. 1) of the radial turbine 16 to supply combustion gas to the radial turbine 16.

The combustion gas created in the combustion chamber 46 flows from the side of the end wall 102 to the combustion gas outlet 112 as indicated by letter F in FIG. 2.

Each of the outer peripheral wall 104 and the inner peripheral wall 106 is provided with a plurality of raised wall portions 114 extending in the circumferential direction and spaced at a predetermined interval in the axial direction, and an inclined wall portion 116 connects each pair of adjacent raised wall portions 114. More specifically, as shown in FIG. 3, each inclined wall portion 116 extends circumferentially around the central axis between an outer edge portion 114A (a radially outer edge) of the adjacent raised wall portion 114 on the upstream side with respect to the flow direction F of the combustion gas and an inner edge portion 114B (radially inner edge) of the adjacent raised wall portion 114 on the downstream side with respect to the flow direction F of the combustion gas.

As shown in FIG. 2, a plurality of cooling air holes 120 is formed through each of the raised wall portions 114 at a predetermined interval in the circumferential direction and extends substantially linearly and perpendicularly to the raised wall portion 114 in the longitudinal sectional view. In this embodiment, the cooling air holes 120 are arranged in a single row along the circumferential direction of the raised wall portion 114.

The combustor 18 or the liner 100 thereof is manufactured by the AM process, and the liner 100 is oriented during the execution of the AM process such that the end wall 102 is positioned at the bottom and the central axial line extends vertically. In the following disclosure, the directions such as up and down will be based on this orientation of the liner 100 unless otherwise specified.

Figure 3:
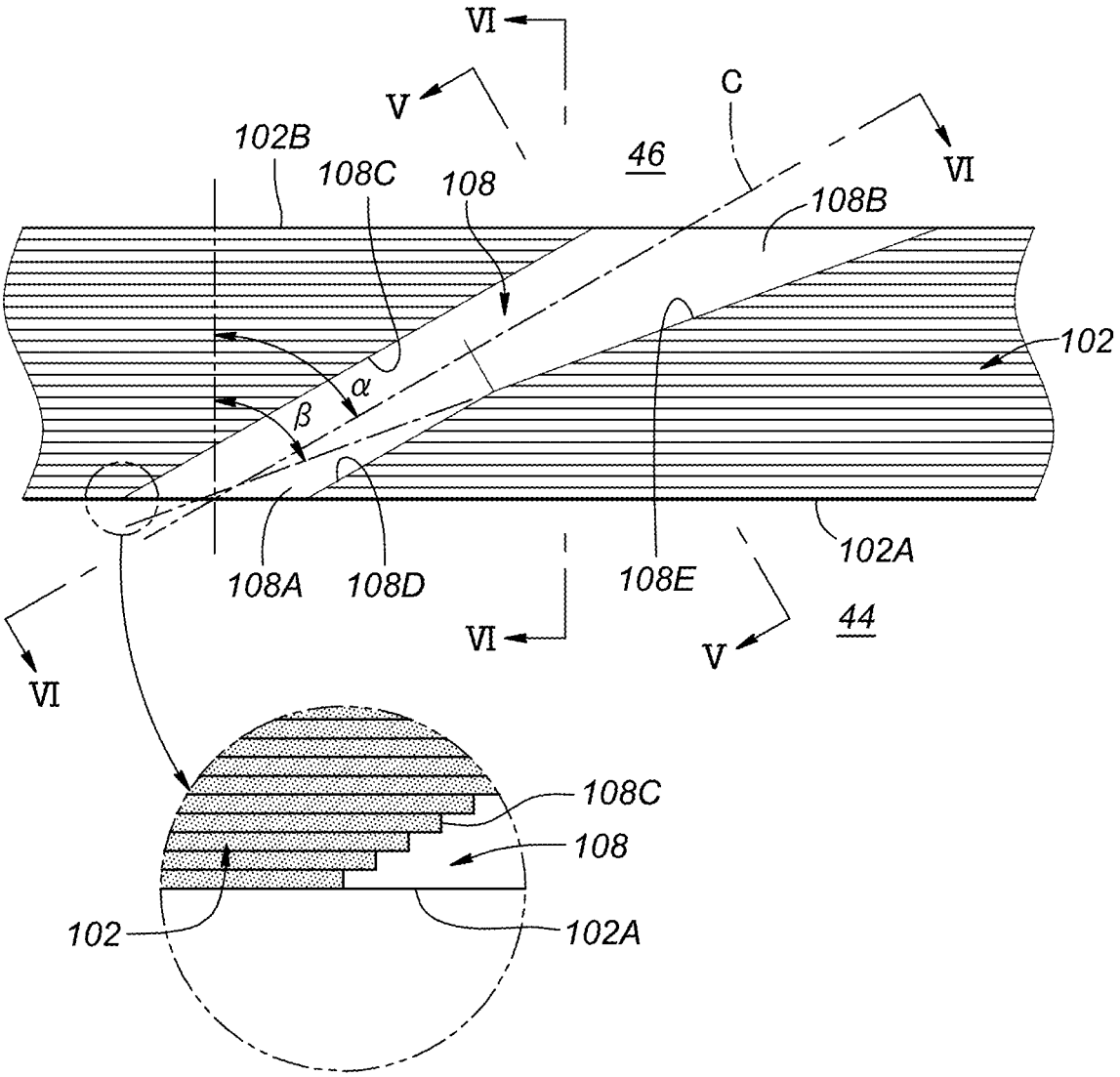
FIG. 3 is an enlarged longitudinal sectional view of the cooling air hole of the liner of the combustor.
Figure 4:
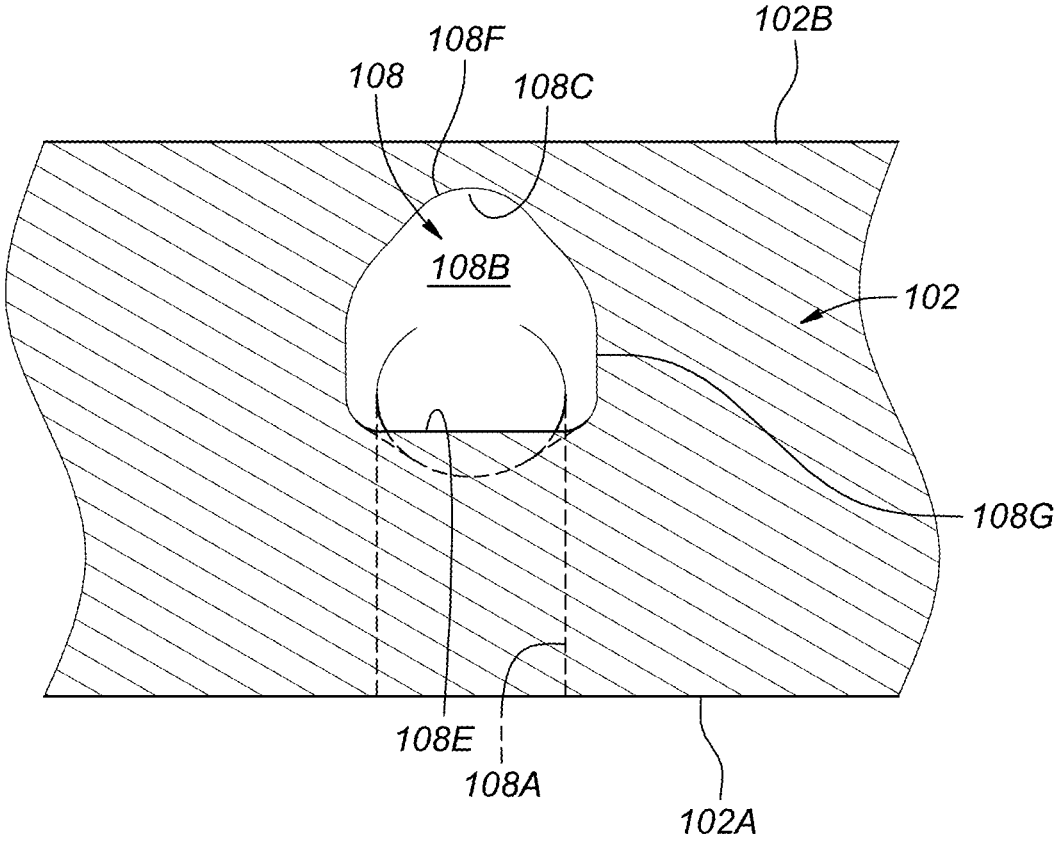
FIG. 4 is an enlarged cross-sectional view of the cooling air hole taken along line IV-IV of FIG. 3.
Figure 5:
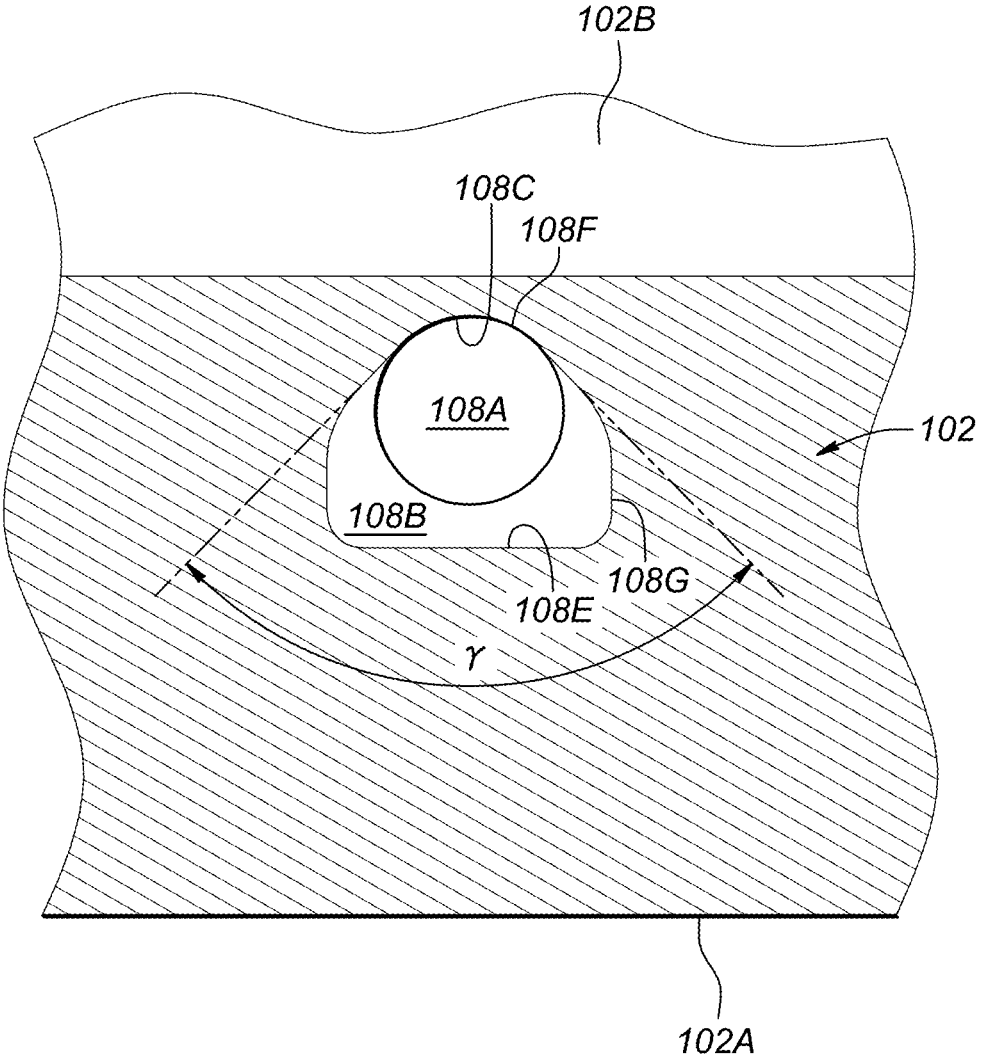
FIG. 5 is an enlarged cross-sectional view of the cooling air hole taken along line V-V of FIG. 3.

As shown in FIGS. 2 to 8, a plurality of cooling air holes (through holes) 108 is formed through the end wall 102, and each cooling air hole 108 extends at an angle to the vertical direction. FIG. 3 is a longitudinal sectional view taken along a plane perpendicular to the wall surface of the end wall 102 and parallel to the inclination direction of the cooling air holes 120. In this embodiment, the lower wall surface (which will be referred to as the first surface 102A) of the end wall 102 facing the compressed air chamber 44 and the upper wall surface (which will be referred to as the second surface 102B) of the end wall 102 facing the combustion chamber 46 are substantially parallel to each other.

Each cooling air hole 108 is a substantially linear through hole that extends from the first surface 102A to the second surface 102B of the end wall 102, and the compressed air, which serves as a cooling medium, flows from the side of the first surface 102A to the side of the second surface 102B as cooling air.

Each cooling air hole 108 includes an upstream portion 108A on the side of the compressed air chamber 44, i.e., on the side of the first surface 102A, which has a circular cross section of a substantially constant inner diameter along the length thereof, and a downstream portion 108B on the side of the combustion chamber 46, i.e., on the side of the second surface 102B, which is progressively enlarged in both lateral and vertical directions from the side of the compressed air chamber 44 to the side of the combustion chamber 46, i.e., in the downstream direction. Thus, the cooling air holes 108 each consist of a shaped hole, similar to the cooling air holes 120 of the inner and outer peripheral walls 104 and 106. The inner diameter of the upstream portion 108A of each cooling air hole 108 is selected such that unsolidified metal does not drip down under the gravitational force during the manufacturing of the liner 100 by the AM method.

As shown in FIG. 3, in the longitudinal sectional view, the upstream portion 108A of the cooling air hole 108 extends linearly and has a constant circular cross section. The downstream portion 108B is flared in a lower half part thereof toward the combustion chamber 46. More specifically, whereas the upper edge 108C (on the side of the second surface 102B) of the downstream portion 108B of each cooling air hole 108 is on the same extension line as the upper edge 108C of the upstream portion 108A, the lower edge 108E (the side of the first surface 102A) of the downstream portion 108B is smoothly connected to the lower edge 108D of the upstream portion 108A and more inclined than the lower edge 108D of the upstream portion 108A. In particular, the inclination angle $\alpha$ of the central axis C of the upstream portion 108A with respect to the normal line of the first surface 102A (thickness direction of the end wall 102) may be 35 degrees to 75 degrees, and is preferably about 60 degrees. The upper edge 108C of the downstream portion 108B and the upper edge 108C of the upstream portion 108A extend along a common straight line in parallel with the central axis of the cooling air hole 108. The inclination angle $\beta$ of the lower edge 108E of the downstream portion 108B with respect to the normal line of the first surface 102A is larger than the inclination angle $\alpha$ of the upstream portion 108A, and may be 40 degrees to 85 degrees, and is preferably about 70 degrees.

As shown in FIGS. 4 to 7, the lower edge 108E of the downstream portion 108B of the cooling air hole 108 is expanded in the lateral direction and defines a substantially flat surface in cross section. The downstream portion 108B thus consists of a shaped part having a larger curvature on a side of the second surface 102B than on a side of the first surface 102A in cross section. Further, the downstream portion 108B has a lateral width that progressively increases toward the side of the second surface along the length of the through hole. When viewed from above in a direction perpendicular to the longitudinal direction (C) of the cooling air hole 108, the vertex angle $\delta$ (see FIG. 6) of the lower edge 108E of the downstream portion 108B may be 5 degrees to 45 degrees, and is preferably about 20 degrees.

The lower edge 108E of the downstream portion 108B is substantially horizontal and planar in cross section. A pair of side edges extend substantially vertically from either lateral end of the lower edge 108E via rounded corners, and bend toward each other toward the upper end of the downstream portion 108B. The upper edge 108C of the downstream portion 108B is substantially conformal to the upper edge of the upstream portion 108A when viewed in the direction of the central axis C. Thus, the cross section of the downstream portion 108B of the cooling air hole 108 includes an upper half part 108F consisting of a rounded isosceles triangular cross section and a lower half part 108G consisting of a rounded rectangular cross section. In particular, in cross section the upper half part 108F of the downstream portion 108B of the cooling air hole 108 includes a top part having a prescribed curvature and a pair of side parts connected to the corresponding ends of the top part and having a smaller curvature than the top part. Thus, an upper half part 108F has a sharp mountain shape. In the illustrated embodiment, the side parts consist of tangential lines connected to the corresponding ends of the top part. Thus, the rounded rectangular lower half part 108G is smoothly connected to the rounded triangular upper half part 108F in cross section. The two oblique sides of the triangular cross section form an apex angle $\gamma$ (see FIG. 5) which may be 70 degrees to 110 degrees, and preferably approximately 90 degrees.

Since each cooling air hole 108 has a larger width on the side of the first surface 102A than on the side of the second surface 102B side in cross section, the cooling air hole 108 can be given with a relatively large cross-sectional area even when the dimension in the vertical direction or the thickness of the end wall 102 is limited. In particular, the cross section of the downstream portion 108B of each cooling air hole 108 is such that the lateral width thereof progressively increases from the side of the first surface 102A to the side of the second surface 102B, so that the cooling air hole 108 can have a particularly large cross-sectional area even when the dimension in the thickness direction is limited.

Since each cooling air hole 108 has a laterally expanded cross-sectional shape on the side of the lower edge 108E of the downstream portion 108B, when the compressed air flows as cooling air from the side of the first surface 102A to the side of the second surface 102B, a laminar flow of cooling air flowing closely along the second surface 102B of the end wall 102 can be created. Since the cooling air holes 108 consist of shaped holes having the above-mentioned configuration, the velocity of the cooling air flowing into the combustion chamber 46 can be decreased, and favorable cooling can be accomplished.

Figure 6:
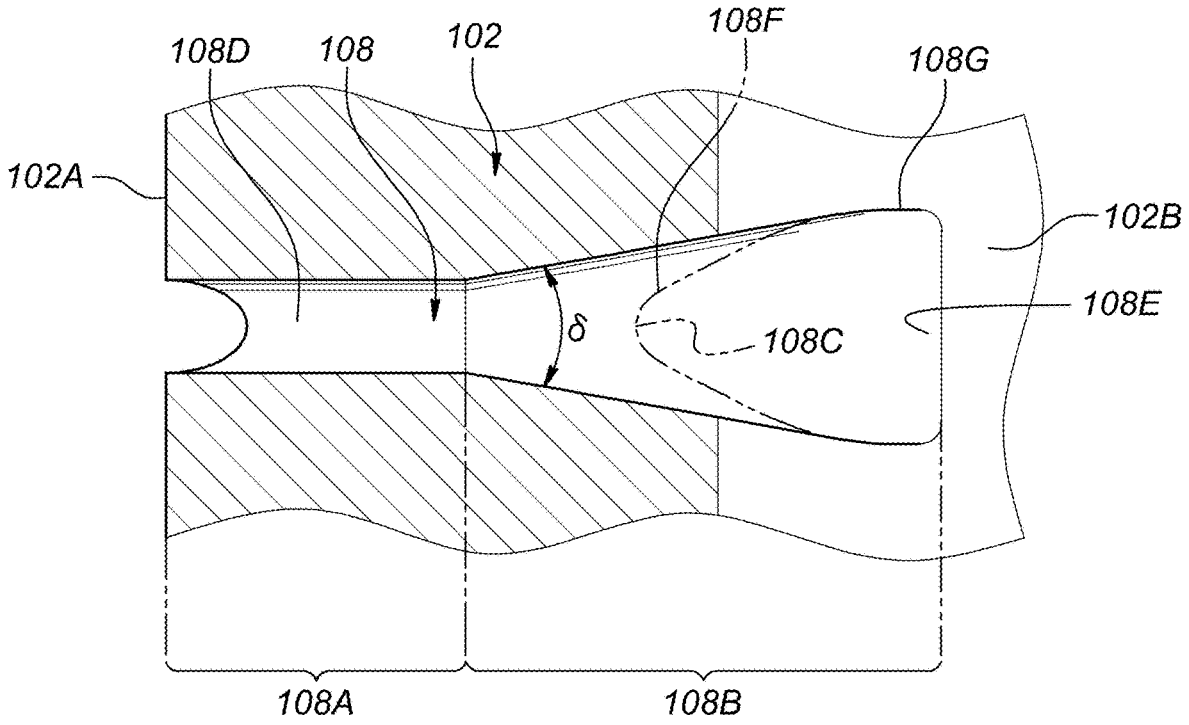
FIG. 6 is an enlarged longitudinal sectional view of the cooling air hole taken along line VI-VI of FIG. 3.
Figure 7:
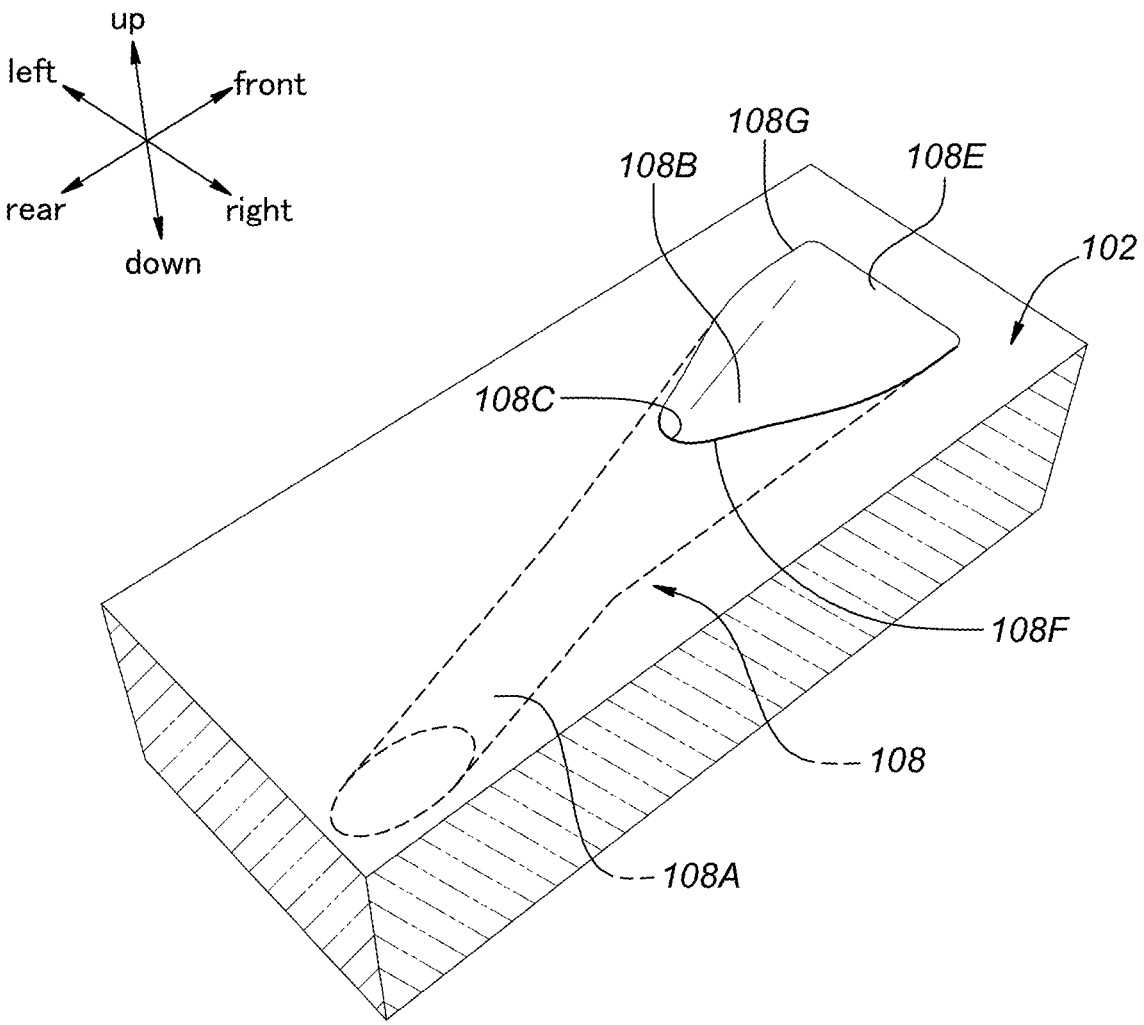
FIG. 7 is a fragmentary perspective view of the end wall showing the cooling air hole from the side of the combustion chamber.
Figure 8:
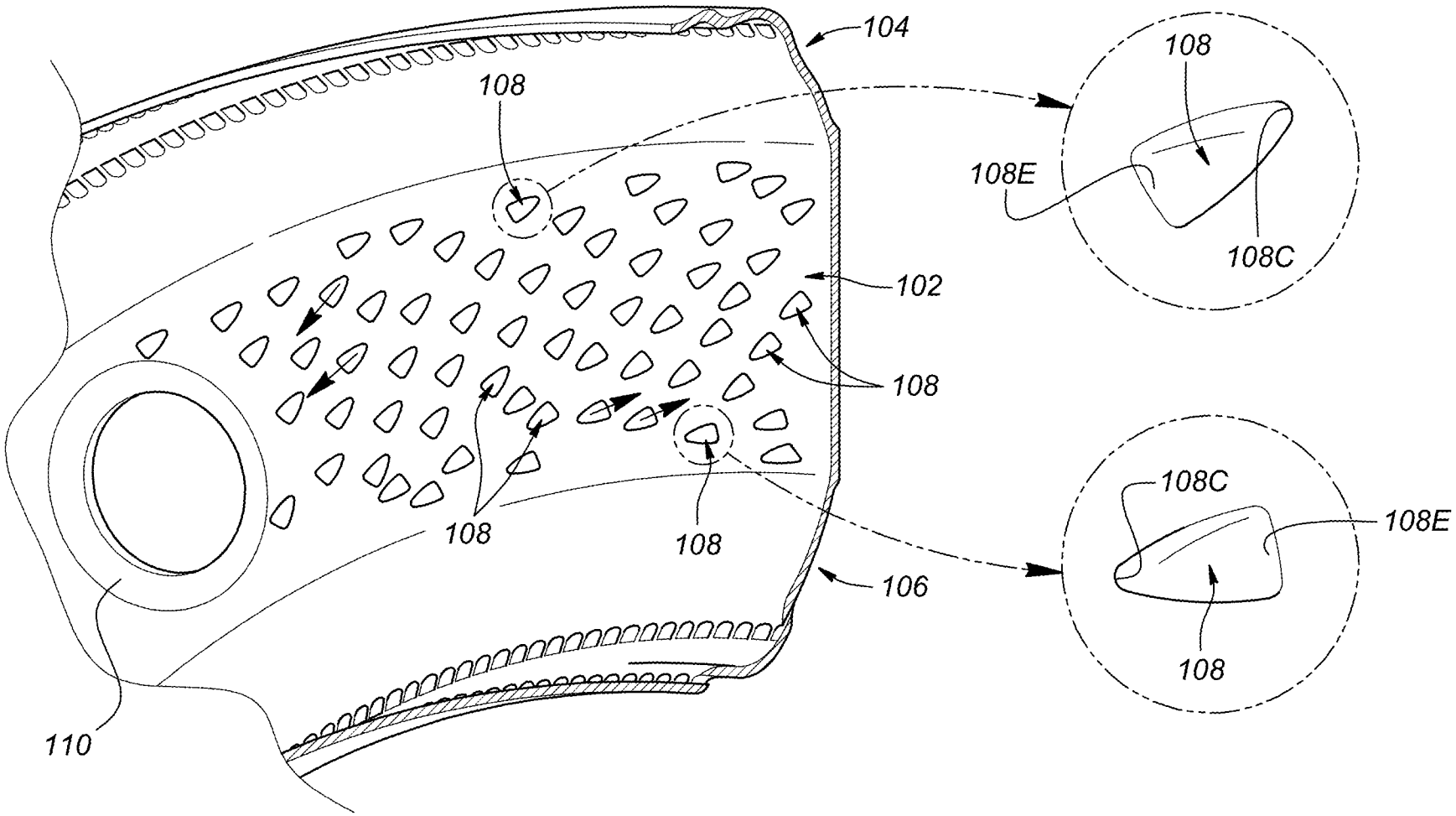
FIG. 8 is a fragmentary perspective view of the end wall showing the cooling air holes from the side of the combustion chamber.

As shown in FIG. 6, each cooling air hole 108 may be formed through the end wall 102 so as to be inclined in a direction intermediate between the circumferential direction and the radial direction in top view. In the present embodiment, in top view, the central axial lines of the cooling air holes 108 on the outer peripheral part are inclined in the clockwise direction and the central axial lines of the cooling air holes 108 on the inner peripheral part are inclined in the counter-clockwise direction, so that the cooling air is ejected from the cooling air holes 108 in a substantially clockwise direction in the outer peripheral part of the end wall 102, and the cooling air is ejected from the cooling air holes 108 in a substantially counter-clockwise direction in the inner peripheral part of the end wall 102. The cooling air holes 108 may be arranged so as to prevent hot spots from occurring in the end wall 102.

Since the cooling air holes 108 formed in the end wall 102 have a relatively complicated shape, it is difficult to manufacture the liner 100 by conventional manufacturing methods such as cutting, casting, laser drilling, and electric discharge machining. Therefore, in this embodiment, the liner 100 of the combustor 18 is manufactured by the AM method in which molten material is added, deposited and joined layer by layer under computer control, and solidified.

During the manufacturing process, metal is deposited or laminated from bottom to top with the end wall 102 as the bottom as shown in FIG. 3. At this time, the cooling air holes 108 are inclined with respect to the vertical direction, but since the upper side of each cooling air hole 108 is formed into a triangular shape as described above, molten or unsolidified metal is not likely to drip down. In this case, the outer peripheral wall 104 and the inner peripheral wall 106 may be manufactured separately from the end wall 102 by the same or another method and joined with each other, or alternatively the outer peripheral wall 104 and the inner peripheral wall 106 may be formed integrally or simultaneously with the end wall 102.

When the liner 100 is being laminated and formed by the AM method with the first surface 102A of the end wall 102 facing downward, since the upper half part 108F (on the side of the upper edge 108C) of each cooling air hole 108 of this embodiment has a rounded triangular shape as opposed to a semicircular shape, the cooling air hole 108 can be suitably formed even if the inclination angle of the central axis thereof is relatively large. The cooling air holes 108 of the above shape can increase the passage cross-sectional area while avoiding the difficulty of manufacturing the liner 100 by the AM method.

The cross section of the through hole should be generally convex in a radially outward direction and is symmetric about a vertically extending center line as through holes generally are. The upper half part being more "acute" than the lower half part means that the upper half part is more pointed upward than the lower half part projects downward. As a consequence, the lower half part of the cross section would be more "obtuse" or "blunt" than the upper half part. (This characterization should be understood to be different from the normal definition of the "acute triangle" which compares the vertex angle with the 90 degree angle.) The dividing line between the upper half part and the lower half part may be a lateral line (1) passing through a vertically middle point of the cross section, (2) passing through a gravitational center of the cross section, (3) dividing the cross section into two equal areas.

For example, the cross section of the through hole may be a rounded triangular shape having a base located at the lower end. The cross section of the through hole may be elliptic, track-shaped or otherwise elongated circular shape, and the upper half is more pointed upward than the lower half. Assuming that the cross section of the through hole has a generally smooth profile, the upper end part of the cross section has a smaller radius of curvature than the lower end part thereof. The cross section may be at least partly polygonal. In any of these cases, it is essential that the upper end part of the cross section is provided with a shape which is less prone to collapsing as compared to a circular arc given as a segment of a true circle. In particular, the radius of curvature of the upper end of the cross section may be smaller than the true circle and may even be zero. In other words, the upper end may be formed by a vertex of a polygon or a curved shape.

Although the present invention has been described in terms of preferred embodiments thereof, it is obvious to a person skilled in the art that various alterations and modifications are possible without departing from the scope of the present invention which is set forth in the appended claims.

For example, the wall member through which the cooling air holes 108 are formed is not limited to the end wall of the liner of a combustor but may also be other wall members of a combustor or any other wall members that form a passage or a housing of any devices such as turbine nozzles, turbine blades, and turbine vanes which are provided with through holes extending at an angle to the normal direction of the wall member.

The present invention is particularly suitable for application to the combustor of a gas turbine engine, and in such a case, the combustor 18 is not limited to an annular type but may also be a can type. In addition, the combustor 18 is not limited to a combustor for a gas turbine engine for power generation and can be applied to combustors for various gas turbine engines, such as combustors for gas turbine engines for aircraft.

The invention claimed is:

1. A wall member having cooling air holes each being formed as a through hole extending from a first surface of the wall member to a second surface opposite from the first surface, the through hole being inclined with respect to a vertical direction by a predetermined inclination angle, wherein in cross section the through hole includes a shaped part having an upper half part and a lower half part, the upper half part being more acute than the lower half part, wherein the wall member is a part of a liner of a combustor for a gas turbine engine, the wall member is an end wall of the liner of the combustor for the gas turbine engine, and the end wall is annular in shape, and central axial lines of the cooling air holes on an outer peripheral part thereof are inclined in a clockwise direction and central axial lines of the cooling air holes on an inner peripheral part thereof are inclined in a counter-clockwise direction, in top view, the end wall being formed with a plurality of mounting portions at predetermined intervals in a circumferential direction for mounting corresponding fuel injection nozzles thereto, the cooling air holes being formed between adjacent mounting portions of the plurality of mounting portions, and each cooling air hole being inclined in a direction intermediate between the circumferential direction and a radial direction in top view, wherein the shaped part of the through hole has a pentagonal shape formed by a triangular upper half part and a rectangular lower half part smoothly connected to the triangular upper half part in cross section, wherein the wall member is a product formed by an Additive Manufacturing method.

2. The wall member according to claim 1, wherein in cross section a top part of the through hole consists of a part of a circle, and side parts of the through hole each consist of a tangential line connected to a corresponding end of the top part.

3. The wall member according to claim 1, wherein the through hole is a cooling medium hole for passing a cooling medium from the side of the first surface to the side of the second surface.

4. The wall member according to claim 1, wherein the triangular upper half part of the shaped part of the through hole has rounded corners.

5. The wall member according to claim 4, wherein the rounded triangular upper half part has an apex angle of 90 degrees or less.

6. The wall member according to claim 4, wherein the rectangular lower half part of the shaped part of the through hole has rounded corners.

7. A method for manufacturing the wall member according to claim 1, wherein an Additive Manufacturing method is used for forming the wall member with the first surface at bottom and the second surface at top.

8. The wall member according to claim 1, wherein the shaped part of the through hole is laterally wider on a side of the first surface than on a side of the second surface in cross section.

9. The wall member according to claim 8, wherein the shaped part of the through hole has a cross section that is progressively enlarged along a length of the through hole toward the side of the second surface.

10. The wall member according to claim 9, wherein the through hole includes, along the length thereof, an upstream portion having a substantially constant cross section located on the side of the first surface and a downstream portion consisting of the shaped part located on the side of the second surface, a lower edge of the downstream portion being more inclined with respect to the vertical direction than an upper edge of the downstream portion.

11. The wall member according to claim 10, wherein an upper edge of the upstream portion and the upper edge of the downstream portion extend along a common line, and the lower edge of the downstream portion is connected to a lower edge of the upstream portion, the lower edge of the downstream portion being more inclined with respect to the vertical direction than the lower edge of the upstream portion.

12. The wall member according to claim 10, wherein the downstream portion has a lateral width that progressively increases toward the side of the second surface along the length of the through hole.

* * * * *